US005772423A

United States Patent [19]

Mandir

[11] Patent Number: 5,772,423

[45] Date of Patent: Jun. 30, 1998

[54] RELATING TO THE CONTROL OF GAS FIRES

[75] Inventor: Kulwant Mandir, Hail Green, Great Britain

[73] Assignee: Valor Limited, Erdington, Great Britain

[21] Appl. No.: 557,180

[22] PCT Filed: Apr. 13, 1995

[86] PCT No.: PCT/GB95/00848

§ 371 Date: Jun. 3, 1996

§ 102(e) Date: Jun. 3, 1996

[87] PCT Pub. No.: WO95/28603

PCT Pub. Date: Oct. 26, 1995

[30] Foreign Application Priority Data

Apr. 13, 1994 [GB] United Kingdom ..... 9407266

[51] Int. Cl.[6] ..... F23Q 1/04

[52] U.S. Cl. ..... 431/254; 431/255; 126/512

[58] Field of Search ..... 126/512; 431/254, 431/255

[56] References Cited

U.S. PATENT DOCUMENTS 1,898,863 2/1933 Williams ..... 431/255

FOREIGN PATENT DOCUMENTS 2164403 7/1973 France .
1221418 7/1966 Germany .
908257 10/1962 United Kingdom .
2211917 7/1989 United Kingdom .

*Primary Examiner*—Carroll B. Dority
*Attorney, Agent, or Firm*—Dorsey & Whitney

[57] ABSTRACT

The present invention discloses a control for a gas fire, the control comprising a support member in which an elongate aperture (1) is formed, and a slide member (5), part (7) of which slide member (5) projects through and is manually movable along said elongate aperture (1). Said slide member (5) is connected via a linkage (9,35) to a gas burner control lever (11) whereby movement of said part (7) along said elongate aperture (1) causes said slide member (5) to move said gas burner control lever (11) between two end regions of available movement, to control a valve (13) and the feed therethrough of gas from a gas inlet (19) to at least one burner. One microswitch (23) is operable by the control lever (11) to activate an igniter (25) towards one end region of the available movement of the control lever, and another microswitch (31) is operable by the control lever (11) to activate and interrupter (17,29) which can close off the supply of gas.

9 Claims, 2 Drawing Sheets

RELATING TO THE CONTROL OF GAS FIRES

REFERENCE TO RELATED APPLICATIONS

This application claims the priority of International Application No. PCT/GB95/00848, filed Apr. 13, 1995 which in turn claims priority of Great Britain Application No. 9407266.7, filed Apr. 13, 1994, which is incorporated herein by reference.

The present invention relates to a control for a gas fire and to a gas fire incorporating such a control.

More particularly the present invention relates to a control for use in controlling a gas burner in a radiant convector or a simulated solid fuel gas fire. Conventionally a simulated solid fuel gas fire comprises a bed of randomly arranged simulated solid fuel elements eg. coals and/or logs, located within a fireplace opening which connects with a flue and usually has a decorative surround. The simulated solid fuel elements rest on a gas burner usually comprising a tray filled with sand or vermiculite, through which gas/air mix supplied by a gas/air mix supply control, is passed. This control for the gas/air mix is located below the tray ie. below the bed of simulated coals and located behind a removable decorative fender. Similarly in certain radiant convector fires, especially flush fitting radiant convector fires, the control is located behind a decorative fender in the lower part of the fire. Thus to ignite and/or adjust such fires, A person must bend down or get down on his/her knees and first remove the decorative fender. This can and does cause problems, especially as ignition and adjustment are often separate controls.

The aim of the present invention is to provide a simple, complete control for a gas fire, which control is readily accessible and operable and suitable for use in flush fitting fireplace installations.

According to the present invention there is provided a control for a gas fire, the control comprising a slide member connected via a linkage to a gas burner control lever whereby movement of said slide member causes said slide member to move said gas burner lever control lever between two end regions of available movement, to control a valve and the feed therethrough of gas from a gas inlet to at least one burner, one microswitch being operable by the control lever to activate an igniter towards one end region of the available movement of the control lever, and another microswitch being operable by the control lever towards the other end region of available movement to activate an interrupter which can close off the supply of gas.

In a preferred embodiment of the present invention an elongate aperture is provided in a support member which is a vertical part of a decorative surround of a fireplace with the elongate aperture being located towards the upper end region of said vertical part. Alternatively the aperture may be located in a horizontal section of the surround. Part of the slide member projects through the aperture and may, if desired, carry a decorative and easily grippable knob to both enhance aesthetics and facilitate use. The linkage connected to the slide member, is located behind said vertical part of the surround and extends downwardly to a pivotal control lever. Preferably the linkage comprises a single rigid, elongate member, pivotally connected to both the slide member and the control lever. Alternatively a multi-part linkage may be used or a Bowden cable may be located between the slide member and the control lever.

Preferably the control lever is pivoted to control a gas flow control valve eg. a ball valve or tapered plug valve, located below a simulated solid element fuel bed of a fire located in the fireplace, the valve controlling the feed of gas/air mix from a gas inlet, preferably via a flame failure device, to one or two burners. The control lever also preferably engages the microswitches during its pivotal movement, one switch being the "on" switch which activates an electronic igniter for ignition at one end region of the slide members movement, and the other switch being the "off" switch which is engageable after compressing a spring at the other end region of the slide members movement to activate an interrupter which closes off the supply of gas/air mix.

Thus by virtue of the control of the present invention, a person can easily adjust the gas burners and preferably ignition and switching off are also controlled by the simple sliding action of the said control. Also the construction of the control of the present invention enables the use of a linkage which is relatively slim and can be easily located in a flush fitting fire wherein the conventional rotatable controls would be of no use due to their normal bulky construction.

The present invention will now be further described, by way of example, with reference to the accompanying drawings, in which.

Figure 1:
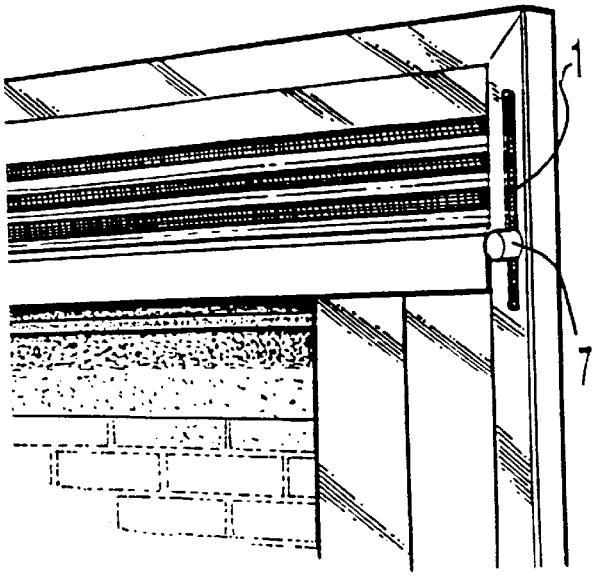
FIG. 1 is a perspective view of part of a gas fire incorporating a control constructed according to the present invention.

As seen in FIG. 1 of the accompanying drawings, a control constructed according to the present invention can, with advantage, be located in the upper region of a fireplace surround, or in the upper region of the front face of a gas fired heater which is to be located in a fireplace opening. The control visibly comprises an elongate aperture (1) through which part (3) of a slide member (5) projects, with a knob (7) secured to said part both for aesthetic reasons and ease of operation.

Figure 2:
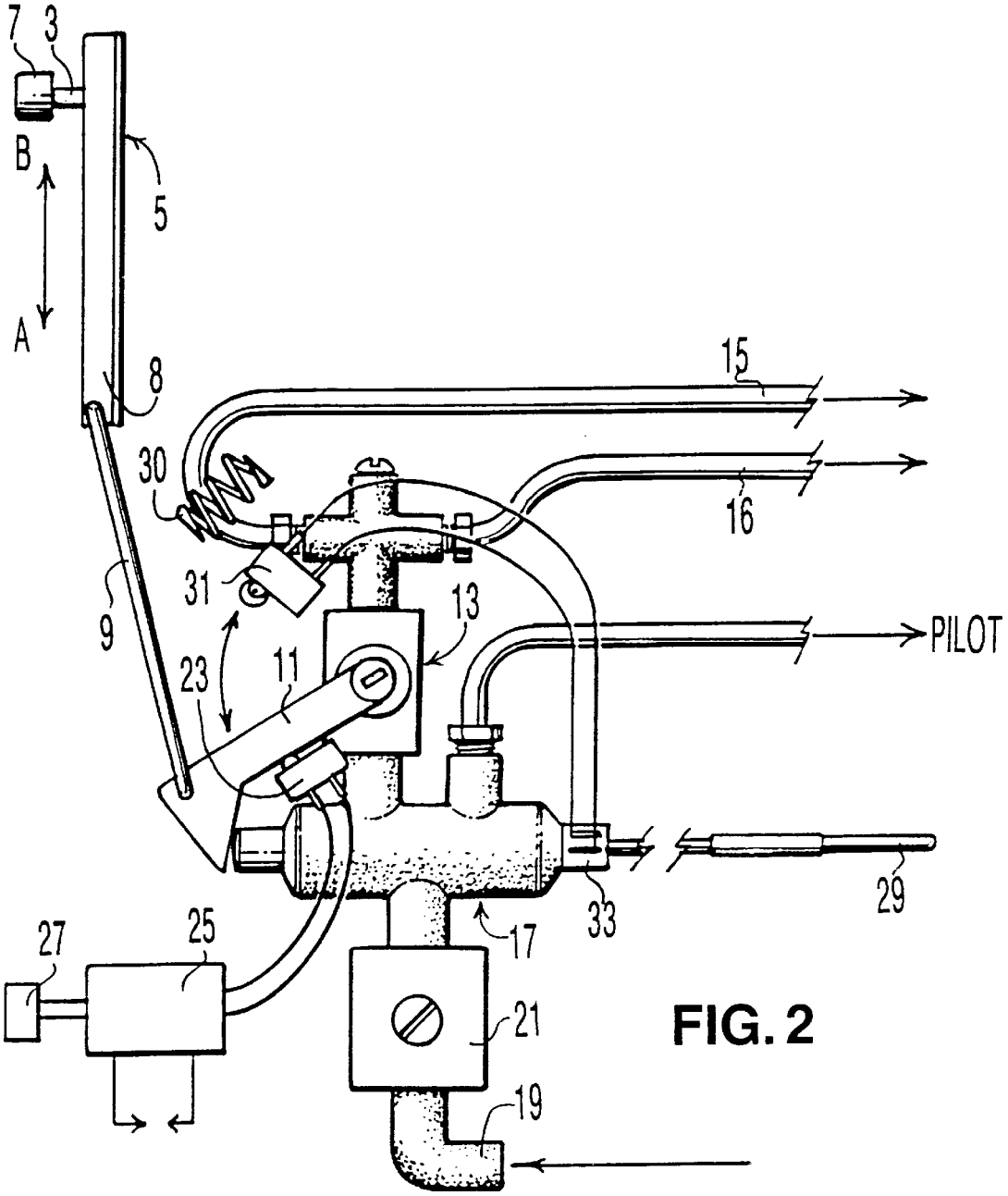
FIG. 2 is a schematic illustration of the control of FIG. 1 connected via a rigid linkage to a gas/air mix supply valve, an igniter and an interrupter.

By manually moving the knob (7) along the aperture (1), the slide member (5)—see FIG. 2, moves in the direction "A" or "B". The lower end region (8) of the slide member (5) is pivotally connected to one end region of elongate linkage (9), the other end region of the linkage (9) being pivotally connected to a pivotal control lever (11). Pivotal movement of the control lever (11) adjusts a gas flow control valve 13 which in use controls the feed of gas/air mix to two burner feed passages (15,16). Movement of the slide member (5) downwards ie. in direction "A", to a maximum extent physically opens a flame failure device 17 to allow gas/air mix to flow from an inlet 19, via a regulator 21, to the flame failure device, the gas flow control valve 13 and the burner feed passages 15,16. The control lever (11) also, in this position, trips a micro-switch 23 which activates an electronic igniter 25 powered by a battery 27, the burners fed via the burner feed passages thus being ignited. By holding the knob (7) in the lowermost position the flame failure device (17) is physically held open. However, the burners eventually heat a thermocouple 29 sufficiently to maintain the flame failure device (17) open and at this time knob (7) can be moved upward ie. in direction "B", to release microswitch 23 and to adjust the gas flow control valve (13) and thus adjust the feed of gas/air mix to the burners to achieve the required performance for the fire. When the knob 7 is in the lowermost region of the aperture 1, the gas flow control valve 13 is adjusted to provide a minimal gas flow. This is however increased towards a maximum by movement of knob 7 upwards in direction "B". When the fire is to be switched off, the knob 7 is moved upwards ie. direction "B" to its maximum position in which the control lever 11 engages a spring 30. Normally this is the maximum operating level of the fire. However by moving the knob 7 further upwards to cause spring 30 to be compressed, the control lever 11 can operate a microswitch 31 which operates an interrupter 33 in the thermocouple circuit of the flame failure device 17 causing the flame failure device 17 to switch off the gas/air mix supply to the burners. By extinguishing the burner, the thermocouple circuit is de-activated causing the flame failure device 17 to operate normally. Knob 7 can then be released so that the spring 30 moves the control lever 11 away from micro switch 31. The fire is thus switched off but ready for subsequent use. In a modified embodiment (not illustrated) the knob 7 is moved in direction "A" to maximise the gas flow and the fires performance.

Figure 3:
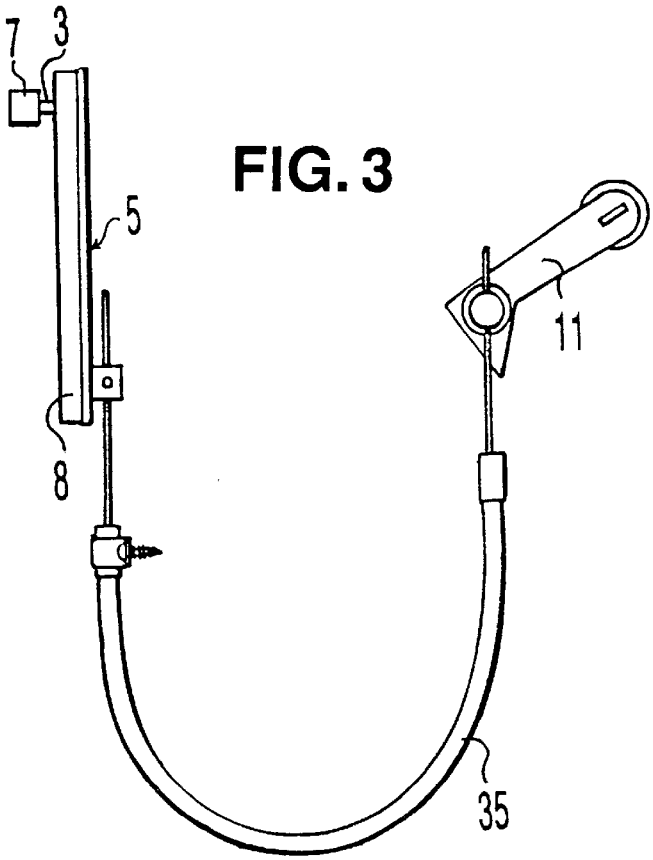
FIG. 3 is a schematic illustration of a modified form of linkage.

Whilst the rigid linkage of FIG. 2 comprises a single elongate member (9), any other linkage can be substituted as desired. In the construction of FIG. 3, a Bowden cable (35) has been located between the slide member 5 and the control lever 11.

Thus the present invention provides a simple burner slide control for a gas fire, for which control is especially useful in a flush fitting fireplace installation, where conventional rotatable controls cannot be fitted due to relatively bulky components, the control of the present invention being readily accessible without an operator having to bend down and without being two obtrusive so as to impair the aesthetics of the fireplace installation.

I claim:

1. A control for a gas fire, the control comprising a slide member (5) connected via a linkage (9,35) to a gas burner control lever (11) whereby movement of said slide member (5) causes said slide member (5) to move said gas burner lever control lever (11) between two end regions of available movement, to control a valve (13) and the feed therethrough of gas from a gas inlet (19) to at least one burner (15,16), one microswitch (23) being operable by the control lever (11) to activate an igniter (25) towards one end region of the available movement of the control lever (11), and another microswitch (31) being operable by the control lever (11) towards the other end region of available movement to activate an interrupter (17) which can close off the supply of gas.

2. A control as claimed in claim 1, in which the control lever (11) is pivotally arranged to control the gas flow control valve (13).

3. A control as claimed in claim 1, in which the valve (13) is a tapered plug valve.

4. A control as claimed in claim 1 in which a flame failure device (17,29) is located in the gas supply from the gas inlet (19) and is physically engageable and openable by the movement of the control lever (11) towards said one end region of the available movement of the control lever (11).

5. A control as claimed in claim 4, in which the flame failure device (17,29) serves as said interrupter and can be closed by the control lever (11) engaging and operating said another microswitch (31).

6. A control as claimed in claim 1 in which a spring (30) is located between the control lever (11) and said another microswitch (31), the control lever (11) having to compress the spring (30) before it can engage and operate said another microswitch (31).

7. A gas fire incorporating a control as claimed in claim 1 in which part (7) of said slide member (5) projects through an elongate aperture (1) in a support member and is manually movable therealong, said support member being part of a surround for the fire with the elongate aperture (1) being arranged vertically.

8. A gas fire as claimed in claim 7, in which the slide member (5) is movable upwards to open the valve (13) and activate the interrupter (17), downwards movement closing the valve (13) to a minimum open position and activating the igniter (25).

9. A gas fire as claimed in claim 7, in which the slide member (5) is movable downwards to open the valve (13) and activate the interrupter (17), upwards movement closing the valve (13) to a minimum open extent and activating the igniter (25).

* * * * *